US005094577A

United States Patent [19]

Clark et al.

[11] Patent Number: 5,094,577

[45] Date of Patent: Mar. 10, 1992

[54] MINE ROOF EXPANSION ANCHOR

[75] Inventors: Carl A. Clark, Liverpool; Raymond L. Wright, Syracuse, both of N.Y.

[73] Assignee: The Eastern Company, Naugatuck, Conn.

[21] Appl. No.: 545,847

[22] Filed: Jun. 29, 1990

[51] Int. Cl.[5] ..... E21D 21/00; F16B 13/10

[52] U.S. Cl. ..... 411/64; 411/55; 405/259.1

[58] Field of Search ..... 411/55, 63–66, 411/50–53, 57, 60; 405/259, 260, 261

[56] References Cited

U.S. PATENT DOCUMENTS

| | | | |
|---|---|---|---|
| 2,667,099 | 1/1954 | Lewis | 411/47 |
| 2,783,673 | 3/1957 | Lewis et al. | 405/259 |
| 3,315,557 | 4/1967 | Dickow | 411/47 |
| 4,158,983 | 6/1979 | Amico | 411/55 |
| 4,278,006 | 7/1981 | Lobello | 411/55 |
| 4,516,885 | 5/1985 | Calandra, Jr. | 405/261 |
| 4,764,055 | 8/1988 | Clark et al. | 405/261 |
| 4,861,198 | 8/1989 | Stankus | 405/259 |
| 4,913,593 | 4/1990 | Clark et al. | 411/51 |
| 5,018,908 | 5/1991 | Laphon | 405/259 |

*Primary Examiner*—Renee S. Luebke
*Assistant Examiner*—Darnell M. Boucher
*Attorney, Agent, or Firm*—Charles S. McGuire

[57] ABSTRACT

An expansion shell assembly of the type including a pair of unitary expansion shell elements, each having two leaf members joined adjacent their lower ends by bridge portions with a bail fixedly attached at terminal ends to outer surfaces of the bridge portions to maintain the expansion shell elements in assembled relation. The bridge portions include a recessed area extending continuously between its upper and lower edges. The recessed areas are divided into two portions, with the lower portions substantially narrower than the upper portions, wherein terminal ends of the bail are secured. Opposing edges of the shell elements are in spaced, substantially parallel relation with the space therebetween free of any structure extending into such space over the full axial length of the shell elements. Relieved areas extend into the inner surfaces of the bridge portions to provide a clearance for the lower end of a tapered camming plug which is moved between the shell elements to effect radial expansion thereof.

6 Claims, 4 Drawing Sheets

MINE ROOF EXPANSION ANCHOR

BACKGROUND OF THE INVENTION

The present invention relates to mechanical expansion anchors for support of roof bolts in pre-drilled holes in a mine roof, or the like, for 5 reinforcing and stabilizing the surrounding rock formation. More specifically, the invention relates to that class of mechanical expansion anchors having a shell assembly including two pairs of leaf members, the members of each pair being integrally connected to one another, and the two pairs being physically connected and held in assembled relation by a U-shaped bail having terminal ends fixedly attached to the leaf members adjacent their lower ends.

Mechanical expansion anchors are among the most common means presently used to support and reinforce underground rock structures such as mine roofs. Such anchors conventionally include a shell structure which is radially expanded into tightly gripping engagement with the wall of a hole drilled in the rock structure by movement of a tapered plug down the threads of a bolt as the latter is rotated, into the space surrounded by expansion leaves of the shell structure. In some shells all leaf members are integrally joined by a ring-like base member, while in others two or more separate leaf portions are physically attached and held in assembled relation by a bail member which extends over the plug and holds it in proper relation to the shell.

One type of prior art shell assembly includes two pairs of leaf members, the members of each pair being integrally connected to one another adjacent their lower ends by bridge portions which maintain the joined leaf members in laterally spaced relation with an open slot between opposing side edges. The two pairs of leaf members are joined to one another by a bail member having legs extending through the open slot between the leaf members of each pair and fixedly attached at their terminal ends to the bridge portions joining the two leaf members of each pair. The medial portion of the generally U-shaped bail passes over the top of the tapered plug and holds it in place with its smaller end extending into the space surrounded by the upper ends of the leaf members.

In prior art expansion anchors of this type, the expansion capability is limited to radially outward movement of the two pairs of leaf members in unison. That is, while each integrally attached pair of leaf members is moved radially outward into gripping engagement with the drill hole wall, each of the four leaf members of the two pairs cannot move independently, in four quadrants, to engage the wall. In order to achieve maximum gripping force from the external surfaces of the leaf members, it is desireable that each of the four leaf members move radially with respect to all of the other members, rather than only in cooperatively moveable pairs.

Other deficiencies have also been excountered in the use of bail-type expansion anchors having two pairs of interconnected leaf members. For example, it has been necessary in prior art designs to provide interlock means between the two otherwise independent pairs of leaf members to maintain side-by-side positioning when the unit is put into expansion. However, the interlocking portions of the two shell halves may tend to bind together, particularly in tight bore holes, when the two leaf segments are not in exact alignment or do not expand evenly. In such cases, a lockup may occur as one pair of leaf members is expanded outwardly while a downward force is exerted by the camming plug on the other pair.

Another problem which may occur is due to interference between the outer surface of the camming plug and the inner surface of the bridge portion connecting each pair of leaf members. When the plug is moved downwardly to the point that its lower end is adjacent the bridge portions connecting the lower ends of each pair of leaf members, an interference condition may arise, causing a galling restriction which is not acceptable for proper function of the unit.

It is a principal object of the present invention to provide a novel and improved mechanical expansion anchor of the type having two pairs of leaf members wherein the members of each pair are integrally connected to one another by bridge portions adjacent their lower ends, and the two pairs are physically attached by a bail member having two legs fixedly attached at their terminal ends to outer surfaces of the bridge portions.

Another object is to provide an expansion anchor of the foregoing type wherein the tapered camming plug which moves downwardly to effect shell expansion does not physically interfere with internal surfaces of the leaf members as the latter are caused to fully expand.

A further object is to provide a mechanical expansion shell comprising two pairs of leaf members wherein proper operation is ensured without the necessity of interlock means for maintaining alignment between the two otherwise independent shell halves.

Still another object is to provide a radially expansible anchor assembly wherein a cooperative expansion shell and tapered camming plug are so configured on their respective inner and outer surfaces that the likelihood of malfunction is minimized.

Other objects will in part be obvious and will part appear hereinafter.

SUMMARY OF THE INVENTION

In accordance with the foregoing objects, the invention embodies a mechanical expansion anchor having a two-piece shell assembly wherein, in a first aspect of the invention, the thickness of bridge portions integrally connecting each of two pairs of leaf members is reduced by recessed areas to permit relative movement of the leaf members of each pair as the tapered camming plug is moved into the shell assembly. The bridge portions connect each pair of leaf members adjacent their lower ends, and the camming plug is moved downwardly from the upper ends of the leaf members on the end portion of the bolt with which the plug is threadedly engaged. The recessed areas extend continously between the upper and lower ends of the bridge portions, preferably including a first portion adjacent the upper end wherein the terminal end of one of the bail legs is disposed, and a second portion narrower than the first portion adjacent the lower end of the bridge portion. The second portion of the recessed area in each bridge portion may comprise a groove extending between the first recessed portion and the lower end of the bridge portion. The thickness of the bridge portions in the recessed area thereof is such that the leaf members of each pair are moved relative to one another about an axis through the recessed area substantially parallel to the central axis of the shell assembly as the camming plug is forcibly moved downwardly therethrough.

In another aspect of the invention the bridge portions connecting each pair of leaf members are provided with a relieved portion on their inner surface extending from the upper end and tapering inwardly toward the lower end. This relieved portion is configured to enhance downward movement of the lower end of the camming plug between the bridge portions of the leaf members. The taper angle of the inner surface of the bridge portions is cooperatively formed with the external taper of the camming plug to permit movement of the plug without galling of opposing surfaces of the bridge portions and the plug.

Another feature of the shell assembly is the absence of the conventional interlocking portions of the shell halves. That is, prior art expansion shells of the type having two pairs of leaf members with the members of each pair integrally connected to one another by bridge portions at their lower ends have required structure extending into the space between the otherwise independent shell halves in order to maintain proper alignment. The shell assembly of the present invention, on the other hand, is characterized by the absence of such structure, being so configured with respect to the camming plug and bail structure that the interlocking structure, which sometimes led to malfunction of prior art assemblies, is unnecessary.

The foregoing and other features of the expansion anchor of the present invention will be more readily understood and fully appreciated from the following detailed description of the preferred embodiment, taken in conjunction with the accompanying drawings, wherein:

DETAILED DESCRIPTION

Figure 6:
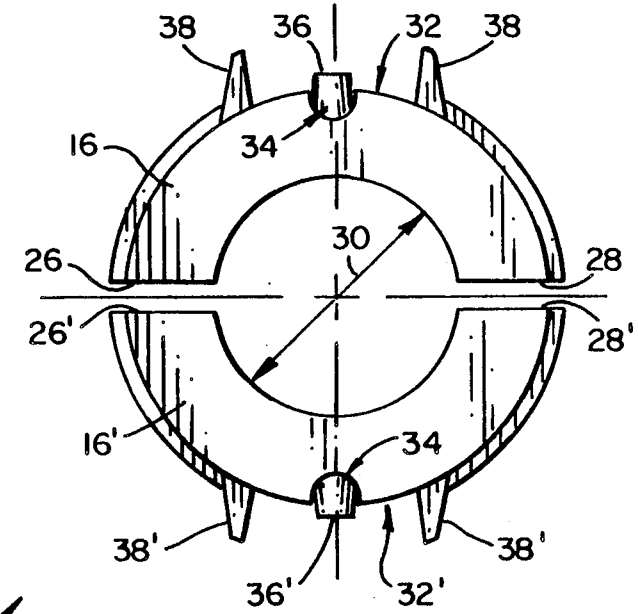
FIG. 6 is a bottom plan view of the two shell halves.
Figure 7:
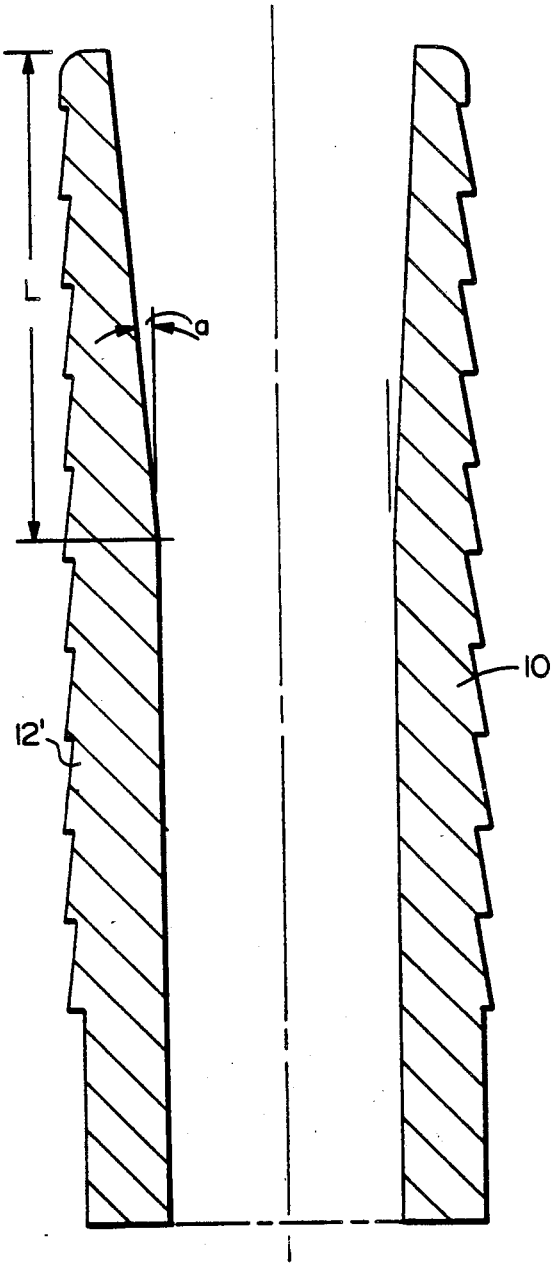
FIG. 7 is an elevational view, in section on the line 7—7 of FIG. 5, showing portions of each shell half.

Referring now to the drawings, in FIGS. 1-4 is seen a unitary element, preferably formed as a malleable iron casting, comprising a first pair of elegonated leaf members 10 and 12, having upper and lower ends 14 and 16, respectively, integrally joined adjacent their lower ends by a bridge portion generally denoted by reference numeral 18. First side edges 20 and 22 of leaf members 10 and 12, respectively, are separated by open slot 24, extending from upper ends 14 of the leaf members to the upper end of bridge portion 18. It is noted that the terms 37 upper" and "lower" are used for convenience to apply to the elements in the illustrated orientation, and as they would be positioned when installed in a substantially vertical drill hole in a mine roof, or the like. The lower end of bridge portion 18 is contiguous with lower ends 16 of the leaf members. The unitary element comprising leaf members 10 and 12 and bridge portion 18 forms one half of an expansion shell assembly, the other half of which is formed by an identical unitary element. In FIGS. 5-7 both halves of the shell assembly are seen, the second pair of leaf members of the other shell half being denoted by reference numerals 10' and 12'; other common elements of the two shell halves are likewise denoted by common reference numerals with a prime sign following numerals applied to elements of the second half. As will later become apparent, the two shell halves are connected by a bail element having end portions fixedly attached to the bridge portion of each shell half. When so connected, second side edges 26 and 28 of the first shell half are in opposed, spaced relation to second side edges 26' and 28' of the other half, and the shell halves are substantially symmetrical about a central axis, as is evident from FIGS. 5 and 6.

The outer surfaces of leaf members 10, 10', 12 and 12' are formed with a succession of stepped serrations from upper ends 14 to a position adjacent the lower end of slots 24, 24', as is common in mine roof expansion anchors. The inner surfaces of the leaf members are smooth and taper inwardly from upper ends 14, 14' toward the central axis for a portion L of the axial length of the leaves, as best seen in FIG. 7. The angle "a" of the taper is formed to cooperate with a taper on the camming plug, described later, and in a preferred embodiment is about 5°, length L comprising some 40% to 50% of the axial length of the leaf members. The inner surfaces of the leaf members below the tapered portion are substantially parallel to the central axis of the shell assembly, lying in a cylindrical plane centered at the axis, as indicated by line 30 in FIG. 6.

A recessed area is formed in the outer surface of each of bridge portions 18, 18'. Each recessed area includes first portion 32, 32' continguous at its upper end with slot 24, 24' and at its lower end with second portion 34, 34', which extends from first portion 32, to the lower end of bridge portion 18, 18'. Thus, the recessed areas extend continuously from the upper to the lower ends of the bridge portions, reducing the thickness thereof from that of the lower ends of the leaf members which is the same as that of the bridge portions aside from the recessed areas. As is apparent from the drawings, second portion 34, 34' is considerably narrower than first portion 32, 32', being more in the nature of a notch or groove in the external surface of the bridge portion. In any case, the reduction in thickness and the extent of the recessed areas continuously from the upper to the lower ends of the bridge portions, taking into account the type of material of which the elements are constructed, produces the desired operation, as described later.

Studs 36, 36' extend integrally from bridge portions 18, 18' at central locations within first portions 32, 32' of the recessed areas. Ears or tabs 38, 38' likewise extend integrally from bridge portions 18, 18', one such tab being positioned on each side of both first portions 32, 32'. The studs and tabs serve to position and hold in place terminal ends of a bail member in known manner.

Figure 4:
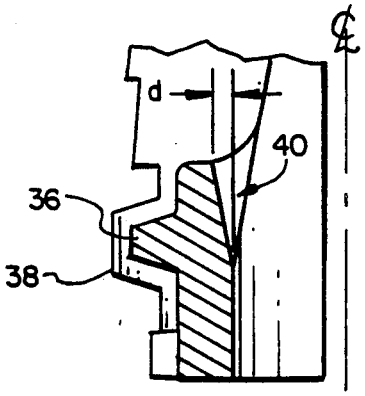
FIG. 4 is a fragmentary, elevational view in section on the line 4—4 of FIG. 3.
Figure 5:
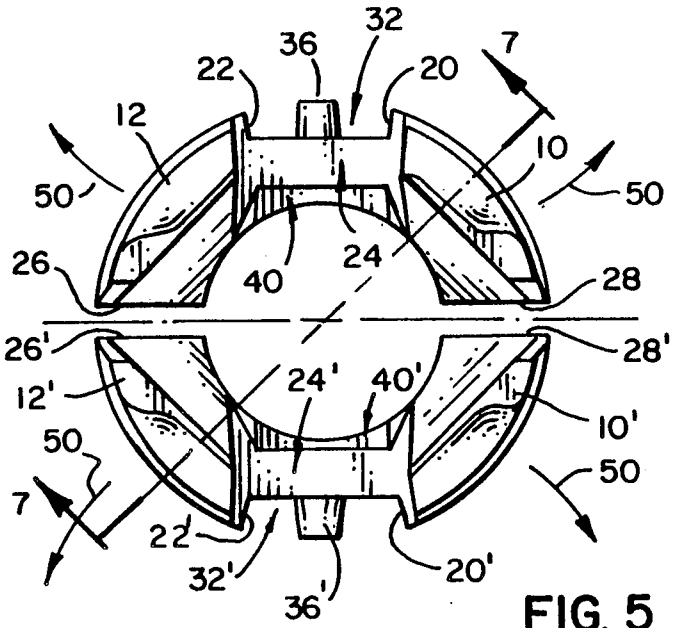
FIG. 5 is a top plan view showing both halves of the shell assembly as they appear in assembled relation.
Figure 3:
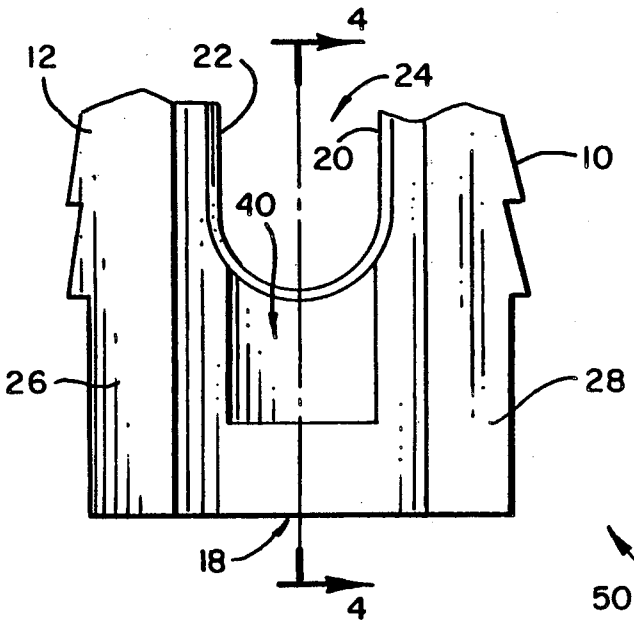
FIG. 3 is a fragmentary, elevational view of a portion of the shell half, showing the inside surface as seen generally from the line 3—3 of FIG. 2.

An additional feature unique to the present invention is the provision on the interior surface of the bridge members of relieved areas 40, 40' having a constant width, as seen in FIG. 3 somewhat less than that of slot 24, and extending into the interior surface of bridge portions 18, 18' at its upper end by depth d (FIG. 4). Relieved areas 40, 40' taper from depth d to merge with the interior surfaces of bridge portions 18, 18' approximately midway between their upper and lower ends, as best seen in FIG. 4. The purpose of relieved areas 40, 40' and their cooperative relationship to the camming plug will be described later.

Figure 8:
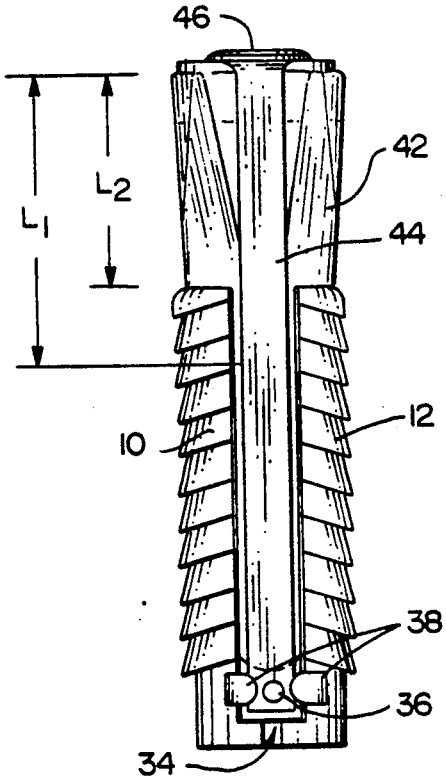
FIG. 8 is a front elevational view of a complete anchor assembly according to the preferred embodiment of the invention.
Figure 9:
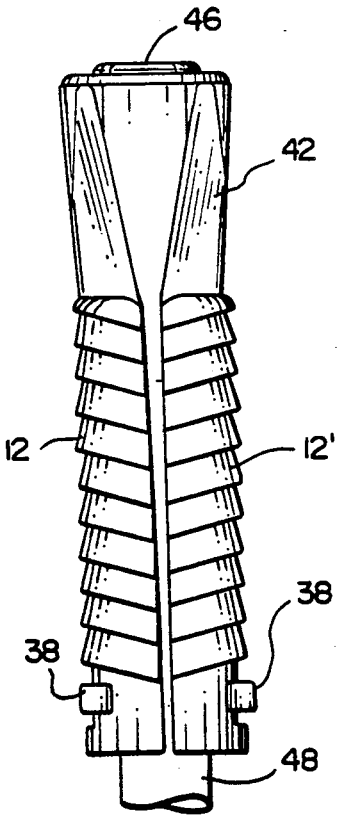
FIG. 9 is a side elevational view of the anchor assembly of FIG. 8.

A fully assembled expansion anchor constructed according to the present invention is shown in FIGS. 8 and 9. Tapered camming plug 42 has an axial length $L_1$ and a smaller end extending into the space surrounded by upper ends 14 of the four leaf members, leaving a length $L_2$ including the larger end of the plug extending above the shell assembly. A conventional, substantially U-shaped bail member includes a pair of legs 44, one of which is seen in FIG. 8, each having an opening adjacent its terminal end. Medial portion 46 of the bail is placed over the upper end of plug 42 with legs 44 extending through slots 24, 24'. The openings in the bail legs are placed over studs 36, 36' and ears 38, 38' are then bent inwardly, as shown in FIG. 8, thus fixedly attaching the bail legs to each shell half and maintaining the unit in the assembled condition.

Figure 1:
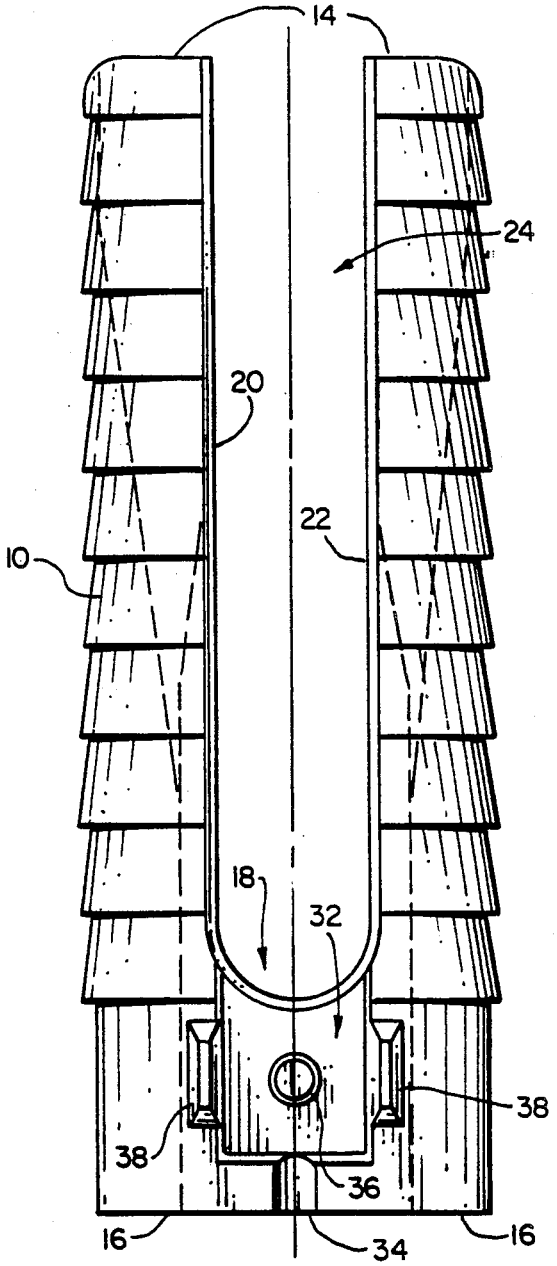
FIG. 1 is a front elevational view of one of the two halves of the shell assembly of the invention.
Figure 2:
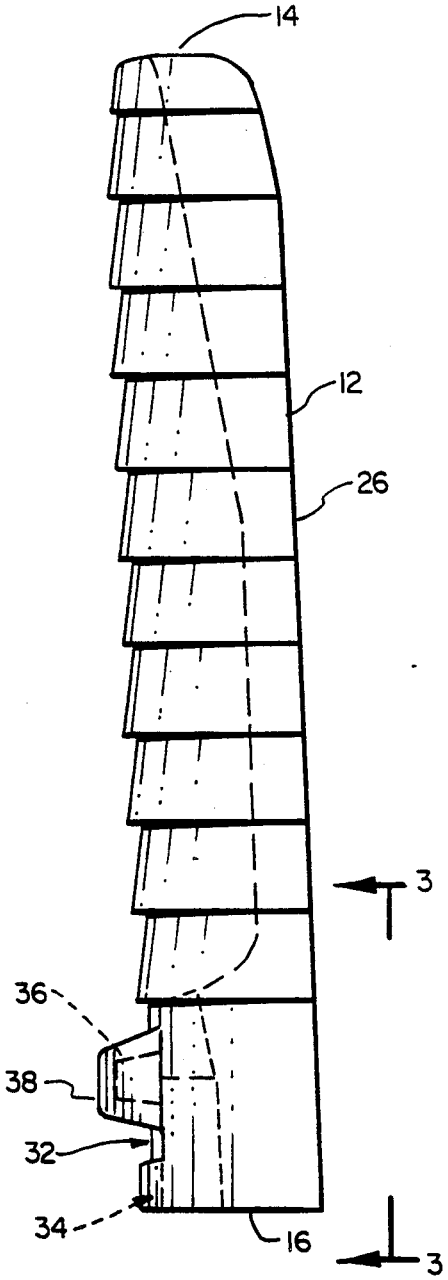
FIG. 2 is a side elevational view of the shell half of FIG. 1.

The crests of the teeth or serrations on the outer surfaces of the leaf members are shown in FIGS. 8 and 9 as angularly disposed with respect to the central axis of the assembly, rather than perpendicular thereto as in FIGS. 1 and 2. However, both arrangements are conventional and the present invention is in no way concerned with the configuration or alignment of the serrations. The expansion anchor of the invention is utilized in the usual manner, i.e., the threaded end of an elongated bolt, such as that indicated in FIG. 9 by reference numeral 48, is threaded into the central bore of plug 42 until the end of the bolt contacts medial portion 46 of the bail.

The end of the bolt carrying the expansion anchor is then inserted into a hole in the rock formation drilled to a depth slightly greater than the length of the bolt. As rotation is imparted to the bolt by a powered wrench engaging the bolt head outside the bore hole, frictional engagement of the leaf members with the bore hole wall inhibits rotation of the anchor, including the plug, whereby the plug travels axially down the threads on the bolt, forcing the larger portion of the plug between the shell halves, moving the leaf members radially outwardly into tightly gripping contact with the bore hole wall and firmly anchoring the bolt in the drill hole.

Although the manner of installation of the bolt and anchor is conventional, as is desired, the action of the anchor elements is distinctly different, in a manner which enhances reliability and maximizes effectiveness of the anchor. For example, although prior art anchors have included recessed areas in the bridge portions connecting the pairs of leaves in each shell half, such areas have been for the purpose of receiving the bail ends, in the nature of first portions 32, 32' of the recessed area of the present shell assembly. Adding second portions 34, 34' to make the recessed area extend continuously from the upper to the lower end of the bridge portion, allows the leaf members of each pair to move in a pivotal manner with respect to one another as expansion takes place. That is, rather than simply moving the shell halves away from one another, as in prior art anchors of this type, leaf members 10 and 12, as well as members 10' and 12', may move in the manner indicated by arrows 50 in FIG. 5, thereby providing four-way expansion in an anchor of a type wherein only two-way expansion (outward movement of each shell half) was previously the norm.

A further advantage is gained by providing relieved areas 40, 40' on the interior surfaces of the bridge portions in the manner indicated. In some installations, e.g., where the rock formation is relatively soft, maximum expansion is necessary, requiring the plug to travel downwardly until its lower end is adjacent the inside of the bridge portions. The relieved areas in the bridge portions permit the lower end of the plug to continue its downward movement, when necessary, without the interference often encountererd in prior art units of this type. This feature of the shell assembly, and others, is particularly evident when a preferred embodiment of camming plug 42 is employed. Such embodiment is shown in FIGS. 10–14, which will now be described.

Figure 10:
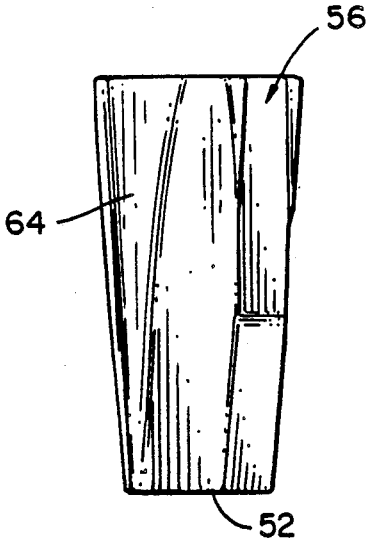
FIG. 10 is a front elevational view of a preferred embodiment of tapered camming plug for use in the anchor assembly of the invention.
Figure 11:
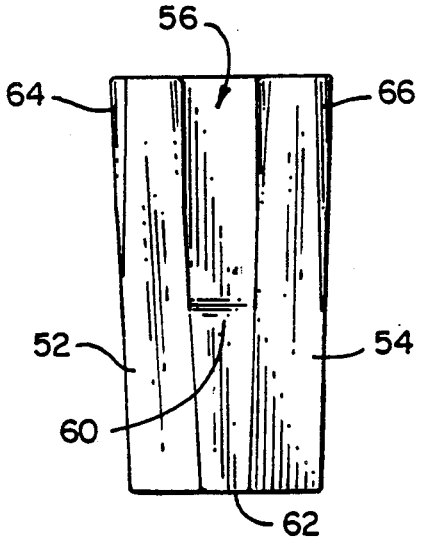
FIG. 11 is an elevational view of the plug rotated 45° from the position shown in FIG. 10.
Figure 12:
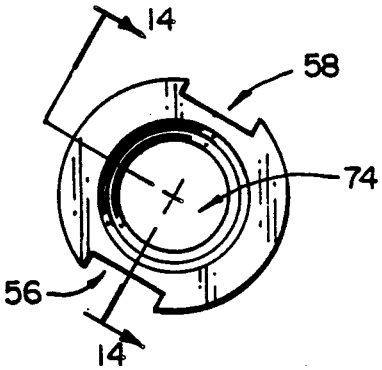
FIGS. 12 and 13 are top and bottom plan views, respectively, of the plug.

Although plug 42 may be described as generally frusto-conical in shape, it is externally configured with four flat sides, one for contact with the interior surface of each of the two pairs of leaf members. These flat sides are relatively narrow where they merge with the upper end of the plug and gradually increase to a maximum width at about the mid-point of the plug length, this width being maintained constant to the lower end. One such flat side is seen in FIG. 10, denoted by reference numeral 52. Flat side 52 is also seen in FIG. 11, together with a second of the four flat sides, numbered 54. Between flat sides 52 and 54, slot 56 extends into the outer surface of plug 42, a second such slot 58 (FIG. 12) being formed in the side of the plug diametrically opposite slot 56. Slots 56 and 58 are about as wide as bail legs 44 and have a depth at the larger end of the plug approximately equal to the thickness of the bail legs, which are received in the slots as they extend downwardly from medial portion 46.

The plug surfaces within slots 56 and 58 have a slight draft angle, e.g., 1°, tapering inwardly toward the central axis of the plug from the upper to the lower end for a portion of the axial length of the plug. For example, the 1° draft angle is maintained from the upper end of the shell down to the position indicated by line 60 in FIG. 11. The draft angle is significantly increased in the surface (also a flat surface) continuing downwardly from the slotted areas. This surface, denoted by reference numeral 62 may also be somewhat narrower than the plug surface in the slotted area, the draft angle being between 5° and 6°, preferably 5°42'.

Slot 58 likewise lies between two flat sides, corresponding to sides 52 and 54. The flat sides adjacent slot 58 are separated from sides 52 and 54 by curved sides 64 and 66 which are relatively wide at the upper and narrow at the lower end of the plug. The draft angles of the four flat sides which contact the interior surfaces of the leaf members, i.e., sides 52 and 54 and the two sides bordering slot 58, is preferably about 5.5°.

Figure 13:
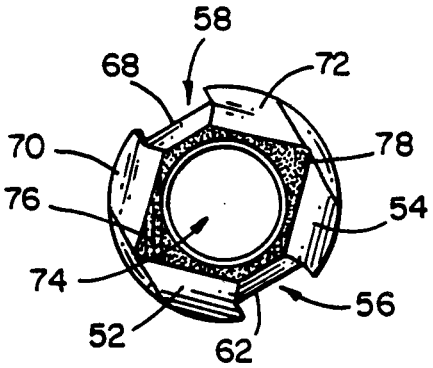
Figure 14:
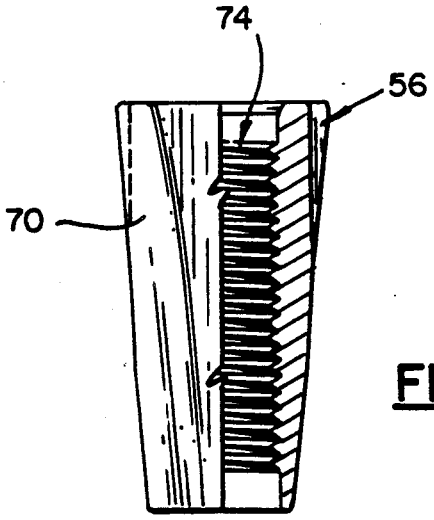
FIG. 14 is an elevational view in half section on the line 14—14 of FIG. 12.

Portions of all external side surfaces adjacent the lower end of plug 42 may be seen in the bottom plan view of FIG. 13. Surface 62 and diametrically opposite surface 68, although somewhat narrower at their junction with the lower end of the plug than the four flat surfaces 52, 54, 70 and 72, are wider than surfaces 64 and 66, which taper essentially to a point at their junction with the lower end of the plug. This has the effect of making the outline of the bottom end of the plug an eccentric shape. For clarity of illustration, the bottom surface of the plug is shaded so that it may be readily differentiated from the surrounding side surfaces. The surface, which surrounds the central, threaded bore 74, is quite narrow, having wider portions, in the nature of lobes indicated by numerals 76 and 78 on opposite sides at the junctures of surfaces 64 and 66 with the lower end of the plug.

What is claimed is:

1. A radially expansible shell assembly for use with a tapered camming plug to anchor an elongated bolt in a bore hole in a rock formation to support and reinforce said formation, said assembly comprising:

a) a pair of unitary shell elements each including two leaf members having upper and lower ends, inner and outer surfaces and first and second side edges, and a bridge portion integrally joining the respective leaf members of each pair adjacent said lower ends thereof, said bridge portion of each of said elements having upper and lower ends, and inner and outer surfaces;

b) bail means including leg portions extending axially of said leaf members and having respective terminal ends fixedly attached to said bridge portions with said terminal ends superposed with said bridge portion outer surfaces, said bail means holding said pair of elements in assembled relation symmetrically arranged about a central axis;

c) said inner surfaces of said leaf members adjacent said lower ends thereof being contiguous with said said inner surfaces of said bridge portions at a substantially uniform distance from said central axis; and d) a relieved area extending into said inner surface of each of said bridge portions from said upper ends of said bridge portions for at least a portion of the distance to the lower ends thereof, said relieved areas being laterally centered with respect to said bridge portions, whereby said relieved areas provide a clearance for said camming plug when the latter travels downwardly between said shell elements.

2. The shell assembly of claim 1 wherein said relieved areas have a width less than, but over one-half, that of said bridge portions.

3. The shell assembly of claim 1 wherein said relieved areas extend from said bridge portion upper ends for less than the full distance to said bridge portion lower ends.

4. The shell assembly of claim 3 wherein said relieved areas extend from said bridge portion upper ends for about one-half the distance to said bridge portion lower ends.

5. The shell assembly of claim 3 wherein said relieved areas have a greatest depth at their juncture with said bridge portion upper ends, and taper inwardly, toward said central axis, to merge with said bridge portion inner surfaces at a position above said bridge portion lower ends.

6. The shell assembly of claim 1 wherein said relieved areas:

i) have a width less than, but over one-half, that of said bridge portions;

ii) extend from said bridge portion upper ends for less than the full distance to said bridge portion lower ends; and iii) have a greater depth at their juncture with said bridge portion upper ends, and taper inwardly, toward said central axis, to merge with said bridge portion inner surfaces at a position above said bridge portion lower ends.

* * * * *